US009842717B2

(12) United States Patent
Jeong

(10) Patent No.: US 9,842,717 B2
(45) Date of Patent: Dec. 12, 2017

(54) HIGH SPEED CLOSING SWITCH

(71) Applicant: LSIS CO., LTD., Anyang-si, Gyeonggi-do (KR)

(72) Inventor: Youngwoo Jeong, Anyang-si (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 15/144,361

(22) Filed: May 2, 2016

(65) Prior Publication Data

US 2016/0351367 A1 Dec. 1, 2016

(30) Foreign Application Priority Data

May 29, 2015 (KR) ..... 10-2015-0076247

(51) Int. Cl.
*H01H 71/24* (2006.01)
*H01H 71/04* (2006.01)
(Continued)

(52) U.S. Cl.
CPC ..... *H01H 71/2481* (2013.01); *H01H 71/04* (2013.01); *H01H 79/00* (2013.01);
(Continued)

(58) Field of Classification Search
CPC .... H01H 71/04; H01H 71/2481; H01H 79/00; H01H 9/04; H01H 9/16; H01H 33/42;
(Continued)

(56) References Cited

U.S. PATENT DOCUMENTS 5,191,180 A * 3/1993 Kitamura ..... H01H 33/666 218/135
6,518,865 B1 2/2003 Al-Hosini et al.
(Continued)

FOREIGN PATENT DOCUMENTS

CN 101563743 10/2009
CN 202013820 10/2011
(Continued)

OTHER PUBLICATIONS

Translation KR101266043 (Original Doc. published May 21, 2013).*

(Continued)

*Primary Examiner* — Renee S Luebke
*Assistant Examiner* — William Bolton
(74) *Attorney, Agent, or Firm* — Lee, Hong, Degerman, Kang & Waimey

(57) ABSTRACT

A high speed closing switch includes a case having an interior which is hermetically closed, a ground electrode installed within the case, a high voltage electrode spaced apart from the ground electrode by a predetermined interval, a movable electrode configured to move from a first position in which the ground electrode and the high voltage electrode are not connected to a second position in which the ground electrode and the high voltage electrode are connected, a coil configured to generate electromagnetic force to cause the movable electrode to be moved from the first position to the second position, a returning rod having one end fixedly connected to the movable electrode and the other end protruding to outside of the case, and a driving device configured to drive the returning rod such that the movable electrode is moved from the second position to the first position.

7 Claims, 5 Drawing Sheets

(51) Int. Cl.
*H01H 79/00* (2006.01)
*H01H 9/04* (2006.01)
*H01H 9/16* (2006.01)

(52) U.S. Cl.
CPC ..... *H01H 9/04* (2013.01); *H01H 9/16* (2013.01); *H01H 2071/046* (2013.01)

(58) Field of Classification Search
CPC ..... H01H 33/38; H01H 33/285; H01H 33/70; H01H 39/004; H02B 13/035
USPC ..... 218/12, 13, 55, 67–69
See application file for complete search history.

(56) References Cited

U.S. PATENT DOCUMENTS

| | | | | |
|---|---|---|---|---|
| 7,919,720 | B2 * | 4/2011 | Shimizu | H01H 31/003 218/62 |
| 8,106,326 | B2 * | 1/2012 | Nakauchi | H01H 31/003 218/55 |
| 8,822,867 | B2 * | 9/2014 | Lee | H01H 33/06 218/59 |
| 2011/0000772 | A1 * | 1/2011 | Hanai | H01H 9/167 200/308 |

FOREIGN PATENT DOCUMENTS

| | | | | |
|---|---|---|---|---|
| DE | 19921173 | | 11/2000 | |
| JP | H0864084 | | 3/1996 | |
| JP | 11025817 | | 1/1999 | |
| JP | 5306144 | | 10/2013 | |
| KR | 10-2002-0032804 | | 5/2002 | |
| KR | 20100063556 | | 6/2010 | |
| KR | 101013709 | | 2/2011 | |
| KR | 20120131509 | * | 1/2012 | H01H 33/42 |
| KR | 101266043 | | 5/2013 | |
| KR | 101280288 | | 7/2013 | |
| KR | 10-2015-0005257 | | 1/2015 | |
| KR | 101491488 | | 2/2015 | |

OTHER PUBLICATIONS

Translation KR1020120131509 (Original Doc. published Dec. 13, 2012).*
Korean Intellectual Property Office Application Serial No. 10-2015-0076247, Office Action dated Aug. 10, 2016, 5 pages.
European Patent Office Application Serial No. 16168299.2, Search Report dated Oct. 6, 2016, 10 pages.
Korean Search Report dated Nov. 17, 2014, 7 pages.
State Intellectual Property Office of the People's Republic of China Application Serial No. 201610371587.6, Office Action dated Sep. 20, 2017, 6 pages.

* cited by examiner

HIGH SPEED CLOSING SWITCH

CROSS-REFERENCE TO RELATED APPLICATION

Pursuant to 35 U.S.C. §119(a), this application claims the benefit of earlier filing date and right of priority to Korean Application No. 10-2015-0076247, filed on May 29, 2015, the contents of which are hereby incorporated by reference herein in its entirety.

BACKGROUND OF THE INVENTION

1. Field of the Invention

The present invention relates to a high speed closing switch, and particularly, to a high speed closing switch in which a returning rod coupled to a movable electrode protrudes to an outer side of a case such that the returning rod may interwork with the movable electrode.

2. Background of the Invention

In general, a switchgear panel receives electric power and supplies electric power required for a load facility installed in each power customer, and to this end, the switch gear panel converts extra-high voltage power into a low voltage power and distributes the same to each customer. In general, the switchgear panel includes a switch, an arrester, a circuit breaker, an arc protection system, various measurement equipment, and the like.

The arc protection system includes a high speed closing switch. When the switchgear panel is normal, a high voltage electrode and a ground electrode of the high speed closing switch are maintained in an open state (non-conducting state), and when an arc accident occurs in the switchgear panel, the movable electrode positioned adjacent to the ground electrode is moved toward the high voltage electrode at a high speed such that the high voltage electrode is grounded through the movable electrode, thus bypassing a fault current.

In order to maintain an internally insulating state, the high speed closing switch is filled with an inert insulating gas, SF6, having excellent insulating characteristics.

As known, the high speed closing switch includes a high voltage electrode, a ground electrode, a movable electrode having a flange portion, first and second Thomson coils for moving the movable electrode to opening and closed positions of the movable electrode via the flange portion, and sensors for sensing the opening and closed positions of the movable electrode within a case formed of an insulating material such as an epoxy, or the like.

The high voltage electrode is connected to a bus of the switchgear panel and high voltage power is constantly applied thereto, and the ground electrode is grounded through a separate ground bus bar or a ground cable.

A first embodiment of the high speed closing switch is disclosed in Korean Patent Laid-Open Publication No. 10-2010-0063556A.

In the document of KR 10-2010-0063556A according to the first embodiment, a movable electrode of a high speed closing switch is positioned on a ground electrode side and open in a standby state, and when a fault current such as an arc occurs, a current is applied to a first Thomson coil disposed toward one side of a flange portion.

When the first Thomson coil is magnetized as the current applied thereto, an eddy current is generated at the flange portion of the movable electrode disposed toward one side of the first Thomson coil, and repulsive force is generated between electromagnetic force generated by the eddy current and electromagnetic force of the first Thomson coil.

Accordingly, the movable electrode is moved toward the high voltage electrode, and the high voltage electrode and the ground electrode are electrically connected through the movable electrode, whereby the high speed closing switch is in a closed state in which the fault current is grounded.

Thereafter, in case the movable electrode is to be returned to an open state, a current is applied to the second Thomson coil disposed toward the other side of the flange portion.

When the second Thomson coil is magnetized upon receiving the current, the movable electrode is moved toward the ground electrode according to an action of electromagnetic force based on the same principle as that described above, and the movable electrode is positioned in the original position, that is, positioned on the ground electrode side, whereby the high speed closing switch is in the open state.

As explained above, the high speed closing switch is placed in the open state or the closed state according to position of the movable electrode.

However, if movement of the movable electrode is defective and thus, the movable electrode fails to sufficiently move toward the ground electrode in the open state, a sufficient insulating distance is not secured between the movable electrode and the high voltage electrode, and thus, the movable electrode and the high voltage electrode are damaged due to defective insulation.

In addition, when the movable electrode fails to sufficiently move toward the high voltage electrode in the closed state due to defective movement thereof, a sufficient electrical contact is not secured between the movable electrode and the high voltage electrode and the movable electrode and the high voltage electrode are damaged by heating due to contact resistance therebetween.

For these reasons, in the high speed closing switch according to the first embodiment, contact sensors are installed within the case to recognize whether a position of the movable electrode is normal. When it is recognized that the movable electrode is in an abnormal position, rather than in an open position or closed position, the arc protection system informs a worker that the movable electrode is in the abnormal position.

However, in the high speed closing switch, the worker cannot recognize a position state of the movable electrode by intuition with his naked eyes, and since the contact sensors are installed within the case, reliability in recognizing the position of the movable electrode is degraded in case an electric line or a related circuit connected to the sensors are disconnected.

A second embodiment of the high speed closing switch according to the related art is similar to the configuration of KR 10-2010-0063556A of the first embodiment as described above. The second embodiment of the high speed closing switch according to the related art discloses that the second Thomson coil is omitted, and that in order to return a movable electrode to an open state, a flange portion of the movable electrode in a closed state is held by using a pair of returning rods actuated through external power and the movable electrode is returned to its original position, that is, toward the ground electrode.

In the high speed closing switch according to the second embodiment, when the movable electrode is returned to its original position, the returning rods are positioned in an initial standby state. This is because, when the flange portion of the movable electrode is repulsed by the first Thomson coil and moves again toward the high voltage electrode, the flange portion of the movable electrode is not to interfere with the returning rods.

In the high speed closing switch according to the related art second embodiment having the foregoing configuration, the movable electrode is opened, that is, returned, by the separate returning rods, while the movable electrode is closed by the first Thomson coil, and thus, the returning rods are considered not to mechanically interwork with a movement of the movable electrode.

As such, since the returning rods and the movable electrode do not interwork with each other, the worker cannot recognize a position of the movable electrode through a position of the returning rods.

Thus, in the high speed closing switch according to the second embodiment, although the returning rods protrude to outside of the case, since the returning rods do not interwork with the movable electrode, in order to recognize a position state of the movable electrode, contact sensors need to be installed within the case as in the high speed closing switch according to the technique of KR 10-2010-0063556A of the first embodiment described above. Thus, the high speed closing switch according to the second embodiment has the same problem as that of the high speed closing switch according to the first embodiment.

In addition, in the high speed closing switches according to the first and second embodiments, a fault current such as an arc is applied and components thereof are moved at a high speed, applying a big load. Thus, in the high speed closing switches according to the first and second embodiments, in order to secure operation reliability, the number of closing operations is set by capacity and by model.

In order to recognize the number of closing operations of the high speed closing switch, the number of operations of the movable electrode needs to be counted.

In the high speed closing switches according to the first and second embodiments, in order to count the number of operations of the movable electrode, a separate counting-dedicated controller is required to receive signals generated form the sensors according to movement of the movable electrode and accumulate the signals to count the number of operations of the movable electrode.

However, counting the operations of the movable electrode in an electrical manner degrades reliability, compared with a mechanical counter, in case an electrical line or a related circuit of the sensors or the counting-dedicated controller is disconnected.

SUMMARY OF THE INVENTION

Therefore, an aspect of the detailed description is to provide a high speed closing switch including a returning rod changed in a degree of protruding from outside of a case according to a position of a movable electrode, allowing a worker may easily determine the position of the movable electrode upon seeing the degree of protruding of the returning rod.

Therefore, another aspect of the detailed description is to provide a high speed closing switch having a function to reliably check the number of times of closing of the high speed closing switch through a mechanical counter driven by a returning rod moved according to movement of a movable electrode.

Technical subjects of the present invention that may be obtained in the present invention are not limited to the foregoing technical subjects and any other technical subjects not mentioned herein may be easily understood by a person skilled in the art from the present invention and accompanying drawings.

To achieve these and other advantages and in accordance with the purpose of this specification, as embodied and broadly described herein, a high speed closing switch includes: a case having an interior which is hermetically closed; a ground electrode installed within the case; a high voltage electrode installed within the case and spaced apart from the ground electrode by a predetermined interval; a movable electrode installed within the case and configured to move from a first position in which the ground electrode and the high voltage electrode are not connected to a second position in which the ground electrode and the high voltage electrode are connected; a coil installed below the movable electrode and configured to generate electromagnetic force to cause the movable electrode to be moved from the first position to the second position; a returning rod having one end fixedly connected to the movable electrode and the other end protruding to outside of the case; and a driving device installed outside of the case, coupled to the returning rod protruding to outside of the case, and configured to drive the returning rod such that the movable electrode is moved from the second position to the first position.

A sensor configured to sense an operation of the returning rod may be installed in a movement path of the returning rod protruding to outside of the case.

The high speed closing switch may further include: a counting-dedicated controller configured to accumulate a signal applied from the sensor and count the number of operations of the movable electrode.

The high speed closing switch may further include: a mechanical counter brought into contact with the returning rod in the movement path of the returning rod protruding to outside of the case and configured to count an operation of the movable electrode interworking with the returning rod.

The sensor may be a contact sensor which is not in contact with the returning rod when the movable electrode is placed in the first position, and which is brought into contact with the returning rod to sense a movement of the returning rod when the movable electrode is moved to the second position.

The case may include: a body part having top and bottoms portions which are open; an upper case configured to hermetically close the open top portion of the body part, to which the high voltage electrode is coupled; and a lower case configured to hermetically close the open bottom portion of the body part, to which the ground electrode is coupled, wherein the returning rod protrudes to outside of the lower case, and a sealing member is installed between the lower case and the returning rod in order to maintain airtightness therebetween.

The sealing member may be at least one of an O-ring and a guide wear ring.

Further scope of applicability of the present application will become more apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Figure 1:
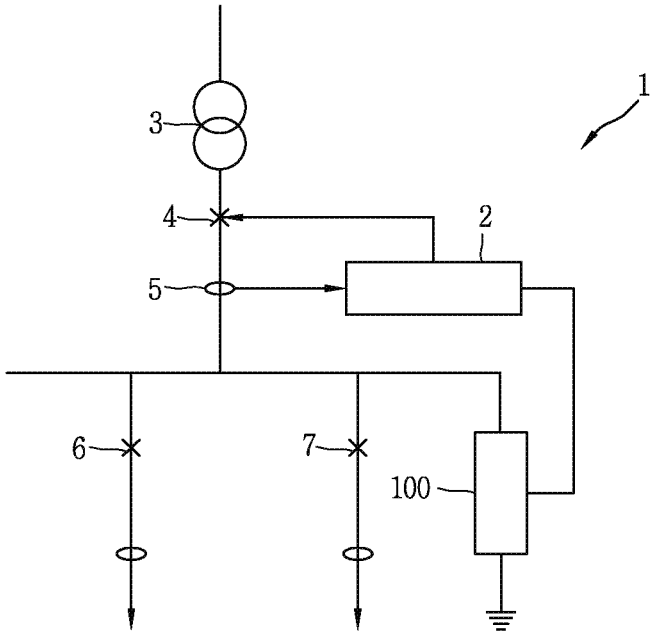
FIG. 1 is an overall schematic view of a switchgear panel in which a high speed closing switch according to an embodiment of the present invention is installed.

Hereinafter, embodiments will be described in detail with reference to the accompanying tables and drawings such that they can be easily practiced by those skilled in the art to which the present invention pertains. As those skilled in the art would realize, the described embodiments may be modified in various different ways, all without departing from the spirit or scope of the present invention.

In the accompanying drawings, a portion irrelevant to description of the present invention will be omitted for clarity. Like reference numerals refer to like elements throughout.

FIG. 1 is an overall schematic view of a switchgear panel 1 in which a high speed closing switch according to an embodiment of the present invention is installed.

Referring to FIG. 1, a switchgear panel 1 includes an arc protection system 2, a transformer 3, a main circuit breaker 4, a current sensor 5, a first circuit breaker 6, and a second circuit breaker 7, and further includes a high speed closing switch 100.

In order to determine whether a fault current is an arc accident, a light receiving sensor (not shown) receiving light emitted from an arc generated within the switchgear panel 1 is installed. When an arc accident occurs, the arc protection system 2 may determine whether an arc accident has occurred upon receiving a light signal sensed by the light receiving sensor or an overcurrent signal provided from the current sensor 5 provided within the switchgear panel 1.

Or, the arc protection system 2 may determine whether an arc accident has occurred upon simultaneously receiving the two signals, that is, the overcurrent signal and the light signal.

When the arc protection system 2 determines that an arc has occurred in the switchgear panel 1, the arc protection system 2 issues a closing command to the dedicated high speed closing switch 100 and simultaneously issues a trip command to the main circuit breaker 4.

According to the closing command from the arc protection system 2, the high speed closing switch 100 performs a closing operation before the circuit breaker 4 performs its own closing operation, so the arc fault current is bypassed toward a ground, and accordingly, damage that may be done due to the arc within the switchgear panel 1 may be minimized.

Thereafter, according to the closing command from the arc protection system 2, the circuit breaker 4 also breaks the fault current to protect the switchgear panel 1 from the fault current.

Figure 2:
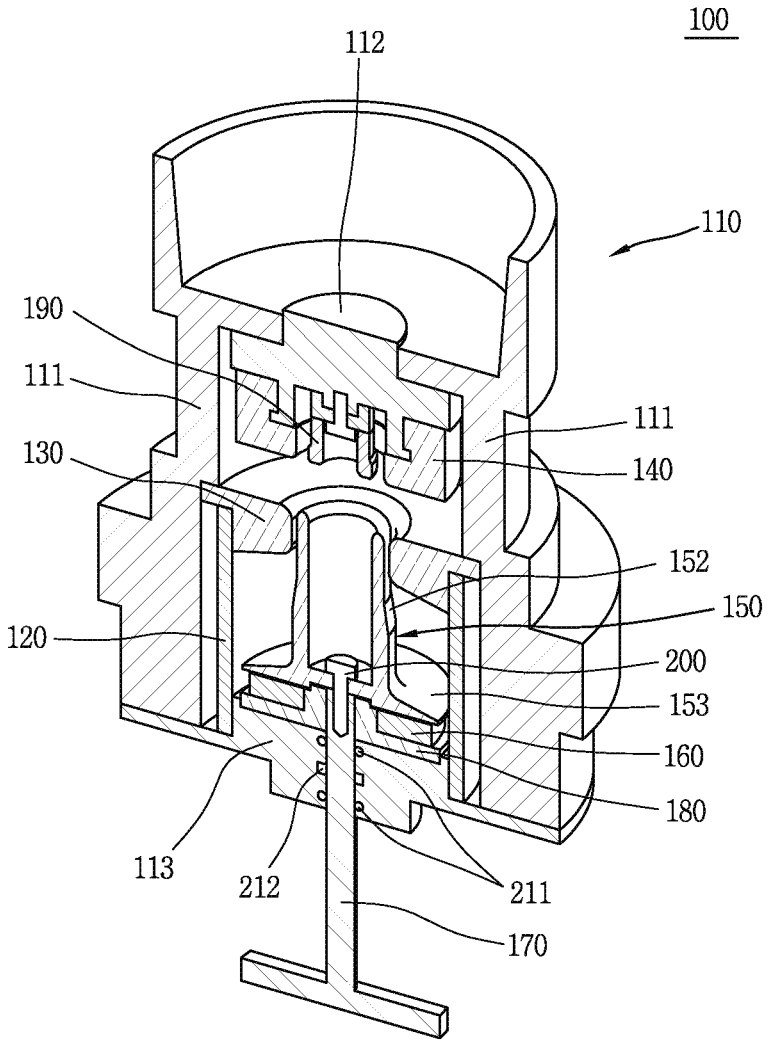
FIG. 2 is a partial cross-sectional perspective view of a high speed closing switch according to an embodiment of the present invention.
Figure 3:
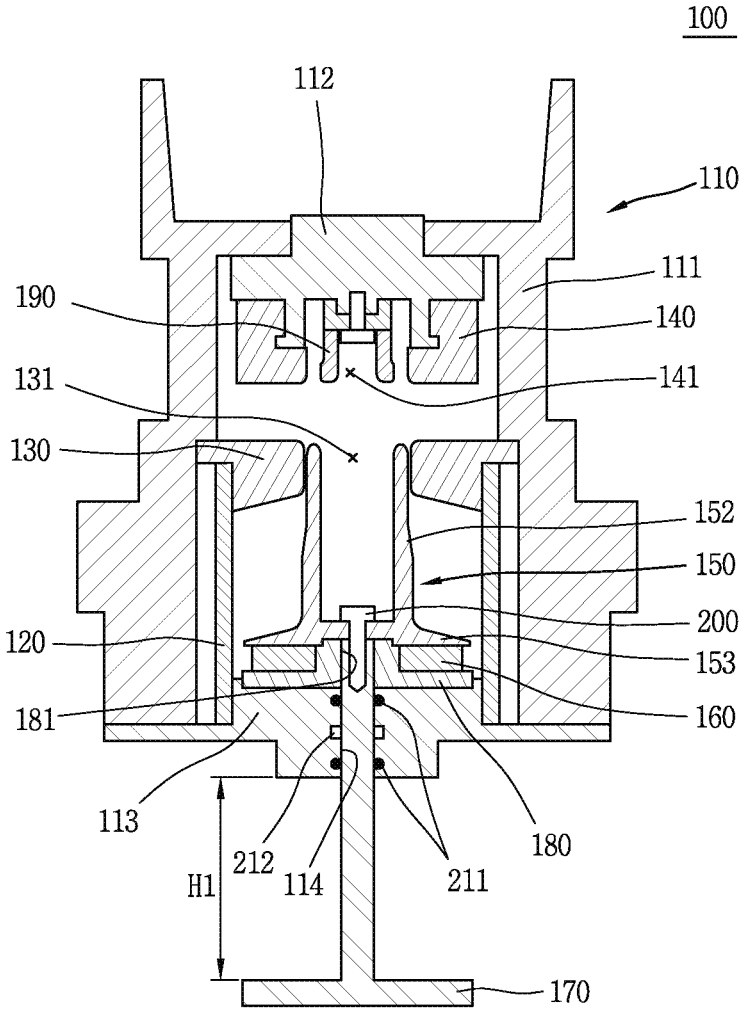
FIG. 3 is a cross-sectional view illustrating an open state of a high speed closing switch according to an embodiment of the present invention.
Figure 4:
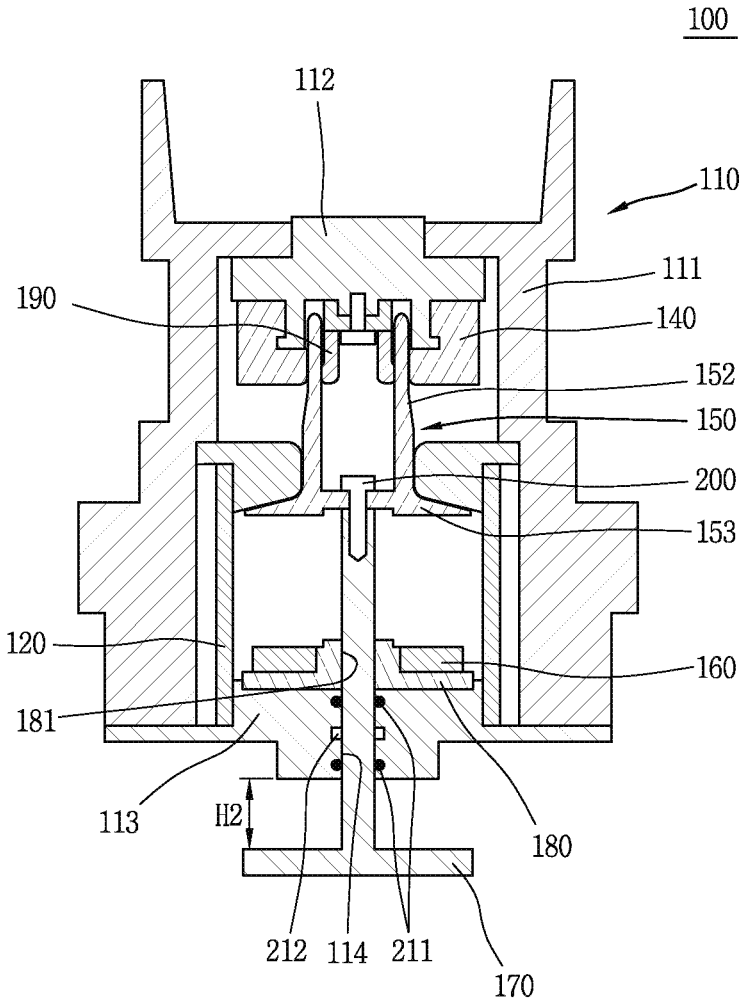
FIG. 4 is a cross-sectional view illustrating a closed state of a high speed closing switch according to an embodiment of the present invention.

FIG. 2 is a partial cross-sectional perspective view of a high speed closing switch according to an embodiment of the present invention. FIG. 3 is a cross-sectional view illustrating an open state of a high speed closing switch according to an embodiment of the present invention. FIG. 4 is a cross-sectional view illustrating a closed state of a high speed closing switch according to an embodiment of the present invention.

Referring to FIGS. 2 through 4, the high speed closing switch 100 includes a case 110, forming an outer appearance, a ground electrode 130 installed within the case 110, a high voltage electrode 140 installed within the case 110 and spaced apart from the ground electrode 130, a movable electrode 150 movably installed within the case 110, a closing coil 160 installed within the case 110 and moving the movable electrode 150 to a closed position, and a returning rod 170 having one end coupled to the movable electrode 150 installed within the case 110 and the other end protruding to outside of the case 110.

The case 110 may include a body part 111 formed of an insulating material such as epoxy and having open top and bottom portions, an upper case 112 coupled to the top portion of the body portion 111 to cover the open top portion of the body part 111 and formed of a conductive material, and a lower case 113 coupled to the bottom portion of the body part 111 to cover the open bottom portion of the body part 111 and formed of a conductive material.

Here, the upper case 112 may be integrally formed with the high voltage electrode 140.

Alternatively, the upper case 112 may be configured as a member separated from the high voltage electrode 140 and coupled to the high voltage electrode 140, and in this case, the high voltage electrode 140 is installed in an upper portion within the case 110.

The upper case 112 and the lower case 113 may be installed in the body part 111 to hermetically close the interior of the case 110, and after the interior of the case 110 is hermetically closed by the upper and lower cases 112 and 113, the interior of the case 110 may be filled with an insulating gas through a separate passage (not shown).

However, a configuration in which the interior of the case 110 is filled with the insulating gas is not limited to the aforementioned example and any known configuration may be used.

Also, the insulating gas filling the interior of the case 110 is not particularly limited and any known gas may be used as long as it is an inert gas.

For example, the inert gas may be, preferably SF6, N2 or air without moisture.

The ground electrode 130 is supported by a pipe 120 supported on the lower case 113.

In detail, the ground electrode 130 is coupled to and supported by an upper inner surface of the pipe 120, and a lower end of the pipe 120 is supported by the lower case 113.

Here, the pipe 120 is formed of a conductive material, and the lower case 113 and the ground electrode 130 are conducted.

The ground electrode 130 may be installed in a middle portion of the case 110.

The ground electrode 130 has an insertion hole 131 formed in an axial direction thereof.

The movable electrode 150 is inserted into the insertion hole 131.

When a closing operation is performed, the insertion hole 131 allows the movable electrode 150 is moved toward the high voltage electrode 140 in a sate in which an outer circumferential surface of the movable electrode 150 is in contact with an inner circumferential surface of the ground electrode 130.

The high voltage electrode 140 has a connection hole 141 formed in an axial direction thereof.

The connection hole 141 is formed to allow an outer circumferential surface of the movable electrode 150 is in contact with an inner circumferential surface of the high voltage electrode 140 formed by the connection hole 141, when the movable electrode 150 is inserted into the connection hole 141.

On a bottom surface of the upper case 112 positioned within the high voltage electrode 140, an arc electrode 190 is installed to minimize an arc that may occur between the high voltage electrode 140 and the movable electrode 150 when a closing operation or an opening operation is performed.

Meanwhile, as mentioned above and as illustrated, the high voltage electrode 140 and the ground electrode 140 are configured to be spaced apart from one another within the case 110, but the present disclosure is not limited thereto and any known configuration may be used.

The high voltage electrode 140 may be electrically connected to an electric circuit of at least one among an incoming panel, a distribution board, and the switchgear panel 1 described above through the upper case 112, and the ground electrode 130 may be electrically connected to a ground side through the pipe 120 and the lower case 113.

Within the case 110, the movable electrode 150 is installed to move between a first position, that is, an open position, in which the ground electrode and the high voltage electrode 140 are not electrically connected, and a second position, that is, a close position, in which the ground electrode 130 and the high voltage electrode 140 are electrically connected.

The movable electrode 150 includes a moving portion 152 and a flange portion 153.

The moving portion 152 of the movable electrode 150 is formed to be hollow.

The moving portion 152 of the movable electrode 150 may also be formed to be solid, but in order to facilitate the understanding of the present disclosure, the hollow moving portion 152 is provided.

The moving portion 152 has an outer circumferential surface inserted into the insertion hole 131 of the ground electrode 130 and the connection hole 141 of the high voltage electrode 140 so as to be in contact with an inner circumferential surface of the ground electrode 130 and an inner circumferential surface of the high voltage electrode 140, when a closing operation is performed.

Also, the moving portion 152 has an inner circumferential surface which is moved in contact with an outer circumferential surface of the arc electrode 190, when a closing operation is performed.

The flange portion 153 of the movable electrode 150 is formed at a lower end of the moving portion 152.

The flange portion 153 is disposed between the closing coil 160 and the high voltage electrode 140 and acts as a repulsive plate repulsive to electromagnetic force of the closing coil 160.

The closing coil 160 is provided above the lower case 113, and the closing coil 160 may be a Thomson coil 160.

The Thomson coil 160 may be wound in an annular shape and installed on a support member 180 formed of an insulating material disposed on an upper surface of the lower case 113 of the case 110.

When the Thomson coil 160 is magnetized upon receiving power applied thereto, an eddy current is generated in the flange portion 153 of the movable electrode 150 installed to face the Thomson coil 160, and repulsive force is generated between electromagnetic force generated by the eddy current and electromagnetic force of the Thomson coil 160, and thus, the movable electrode 150 is moved toward the high voltage electrode 140, that is, the movable electrode 150 is moved from an open position to a close position.

When the movable electrode 150 is moved to the high voltage electrode 140 in a closing operation, while the moving portion 152 of the movable electrode 150 is maintained in a state of being in contact with an inner circumferential surface of the ground electrode 130, a front inner circumferential surface of the moving portion 152 is first brought into contact with an outer circumferential surface of the arc electrode 190, and a front outer circumferential surface of the moving portion 152 is then inserted into the connection hole 141 of the high voltage electrode 140 and is brought into contact with the inner circumferential surface of the high voltage electrode 140 formed by the connection hole 141 of the high voltage electrode 140.

Thus, in the closed position, the high voltage electrode 140 is electrically connected to the ground electrode 139 through the movable electrode 150.

Accordingly, a fault current such as an arc generated in an electric circuit does not flow to the electric circuit but flow to the high voltage electrode 140, the movable electrode 150, and the ground electrode 130, whereby the electric circuit such as the incoming panel, a distribution board, and the switchgear panel 1 can be protected from the fault current.

The returning rod 170 is configured such as one end thereof is coupled to the movable electrode 150 and the other end thereof protrudes to outside of the case 110.

To this end, through holes 114 and 181 through which one end of the returning rod 170 penetrates are formed in the lower case 113 and the support member 180, respectively.

One end of the returning rod 170 is inserted through the through hole 114 of the lower case 113 and the through hole 181 of the support member 180 and subsequently coupled by a known coupling unit such as a bolt 200 so as to be supported by the bottom surface of the movable electrode 150.

Meanwhile, since the returning rod 170 is moved with respect to the lower case 113, an insulation gas hermetically sealed in the case 110 may be leaked between the lower case 113 and the returning rod 170.

Thus, as illustrated in FIGS. 2 through 4, in order to prevent leakage of the insulation gas between the lower case 113 and the returning rod 170, a sealing member 210, for example, at least one of an O-ring 211 and a guide wear ring 212, covering an outer circumferential surface of the returning rod 170, may be installed in the lower case 113.

In the high speed closing switch according to the present invention, since the movable electrode 150 and the returning rod 170 are coupled together, when the movable electrode 150 is moved to the closed position of the upper portion of the case 110, the returning rod 170 is also moved to the upper portion of the case 110 cooperatively according to the movement of the movable electrode 150.

Here, a length of the returning rod 170 protruding outside of the case 110 is greater than a distance by which the movable electrode 150 is moved from the open position to the closed position within the case 110.

In other words, as illustrated in FIG. 3, when the movable electrode 150 is placed in the open position, the returning rod 170 may protrude by a first length H1 to outside of the case 110.

Also, as illustrated in FIG. 4, when the movable electrode 150 is moved to the closed position, the returning rod 170 is moved together with the movable electrode 150 to the interior of the case 110, and here, the returning rod 170 protrudes to outside of the case by a second length H2 as a length corresponding to a distance by which the movable electrode 150 has moved is reduced from the first length H1.

In the high speed closing switch according to the present invention configured as described above, the closing of the movable electrode 150, that is, movement of the movable electrode from the first position to the second position, is performed by the closing coil 160, that is, the Thomson coil 160.

Figure 5A:
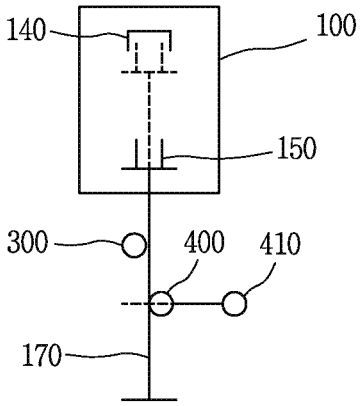
FIGS. 5A and 5B are schematic views according to first and second embodiments of the present invention.
Figure 5B:
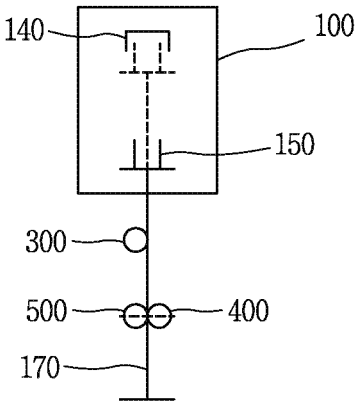

Meanwhile, the opening of the movable electrode, that is, movement of the movable electrode 150 from the second position to the first position, is performed by a returning device 300 as illustrated in FIGS. 5A and 5B.

In detail, the returning device 300 is coupled to the returning rod 170 protruding to outside of the case 110, and drives the returning rod 170 in a downward direction to move the movable electrode 150 from the second position to the first position. Accordingly, the movable electrode 150 fixedly connected to one end of the returning rod 170 is moved to the open position.

Here, the returning device 300 may be operated by various driving units such as a motor, a Thomson coil, or the like.

Meanwhile, in the high speed closing switch 100 according to a first embodiment of the present invention, as illustrated in FIG. 5A, a sensor 400 for sensing an operation of the returning rod 170 may be installed in a movement path of the returning rod 170 protruding to outside of the case 110.

As the sensor 400, any one of a contact sensor or a non-contact sensor may be installed, and for example, the sensor 400 may be a limit switch directly in contact with the returning rod 170 protruding to outside of the case 110.

A signal generated by the sensor 400 is applied to the arc protection system 2 to determine whether a position of the movable electrode 150 is normal.

When the sensor 400 for recognizing a position of the movable electrode 150 is installed outside of the case 110, the sensor 400 and a line related to the sensor as well may be easily checked.

Also, in the high speed closing switch 100 according to the first embodiment of the present invention, since the returning rod 170 moved by interworking with the movable electrode 150 is provided on an outer side of the case 110, a worker may check a position of the returning rod 170 through his naked eyes, as well as recognizing position state information of the returning rod 170 through the arc protection system 2 according to information applied from the sensor 400, whereby a position of the movable electrode 150 may be indirectly recognized.

In the high speed closing switch 100 according to the first embodiment of the present invention, as illustrated in FIG. 5A, the number of times that the returning rod 170 is sensed by the sensor 400 is counted by using a counting-dedicated controller 410, whereby the number of closing of the high speed closing switch 100 may be counted.

Meanwhile, in the first embodiment of the present invention, the sensor 400 may be configured as a contact sensor which is not in contact with the returning rod 170 when the movable electrode 150 is placed in the first position, that is, in the open position, and which is brought into contact with the returning rod 170 to sense movement of the returning rod 170 when the movable electrode 150 is moved to the second position, that is, to the closed position.

Meanwhile, in the high speed closing switch 100 according to the present invention, in order to obtain more reliable count information of the movable electrode 150, as illustrated in a second embodiment illustrated in FIG. 5B, a mechanical counter 500 may be installed in a movement path of the returning rod 170 protruding to outside of the case 110 and brought into contact with the returning rod 170 to count operations of the movable electrode 150.

Here, in the second embodiment, the counting-dedicated controller 410 as in the first embodiment of FIG. 5A to accumulate signals from the sensor 400 to count the number of closing of the movable electrode 150 is not required to be used.

The mechanical counter 500 according to FIG. 5B has high durability, and thus, usage reliability thereof in the high speed closing switch 100 requiring an accurate number of closing is guaranteed.

The foregoing embodiments and advantages are merely exemplary and are not to be considered as limiting the present invention. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A high speed closing switch, comprising:

a case having a hermetically closed interior;

a ground electrode installed within the case;

a high voltage electrode installed within the case and spaced apart from the ground electrode by a predetermined interval;

a movable electrode installed within the case and configured to move from a first position in which the ground electrode and the high voltage electrode are not connected to a second position in which the ground electrode and the high voltage electrode are connected;

a coil installed below the movable electrode and configured to generate electromagnetic force to cause the movable electrode to be move;

a returning rod having first end fixed to the movable electrode and a second end protruding outside the case;

a driving device installed outside the case, coupled to the second end of the returning rod, and configured to drive the returning rod such that the movable electrode is moved from the second position to the first position; and a pipe installed in the case, wherein the case comprises:

a body portion having an open top part to which the high voltage electrode is coupled and an open bottom;

an upper portion configured to hermetically close the open top part of the body portion; and a lower portion configured to hermetically close the open bottom part of the body portion, and wherein the pipe electrically connects the ground electrode to the lower portion of the case.

2. The switch of claim 1, further comprising a sensor installed in a movement path of the returning rod and configured to sense an operation of the returning rod.

3. The switch of claim 2, further comprising controller configured to accumulate signals from the sensor and to count movements of the movable electrode.

4. The high speed closing switch of claim 2, further comprising:

a counter in contact with the returning rod and configured to count movements of the movable electrode.

5. The switch of claim 4, wherein:

the sensor is a contact sensor and is not in contact with the returning rod when the movable electrode is in the first position; and the sensor is brought into contact with the returning rod and senses movement of the returning rod when the movable electrode is in the second position.

6. The switch of claim 5, wherein the returning rod protrudes outside the lower portion of the case and further comprising a sealing member installed between the lower portion and the returning rod in order to maintain airtightness between the lower portion and the returning rod.

7. The switch of claim 6, wherein the sealing member is at least an O-ring or a guide wear ring.

* * * * *